United States Patent [19]

Takashina et al.

[11] 3,990,923

[45] Nov. 9, 1976

[54] METHOD OF PRODUCING GRAIN ORIENTED ELECTROMAGNETIC STEEL SHEET

[75] Inventors: Kikuo Takashina; Yozo Suga; Masahiro Fukumoto, all of Himeji; Takaaki Yamamoto, Kitakyushu; Osamu Tanaka, Kitakyushu; Katsuro Kuroki, Kitakyushu, all of Japan

[73] Assignee: Nippon Steel Corporation, Tokyo, Japan

[22] Filed: Apr. 24, 1975

[21] Appl. No.: 571,475

[30] Foreign Application Priority Data

Apr. 25, 1974 Japan ..... 49-45993

[52] U.S. Cl. ..... 148/111; 148/112

[51] Int. Cl.[2] ..... H01F 1/04

[58] Field of Search ..... 148/111, 112, 31.55

[56] References Cited

UNITED STATES PATENTS

| | | | |
|---|---|---|---|
| 3,159,511 | 12/1964 | Taguchi et al. | 148/111 |
| 3,165,428 | 1/1965 | Albert et al. | 148/111 |
| 3,347,718 | 10/1967 | Carpenter et al. | 148/111 |
| 3,647,575 | 3/1972 | Fiedler et al. | 148/111 |
| 3,700,506 | 10/1972 | Tanaka | 148/111 |

*Primary Examiner*—Walter R. Satterfield

*Attorney, Agent, or Firm*—Wenderoth, Lind & Ponack

[57] ABSTRACT

A method of producing a grain-oriented electromagnetic steel sheet comprising the step of subjecting a sheet of hot-rolled steel containing silicon less than 4.5% to more than one operation of cold rolling and more than one operation of annealing, so as to set the thickness of said sheet to that of a commercially standard sheet, and also subjecting the sheet to the step of final high-temperature annealing. Prior to said final high-temperature annealing, part of the surface of said sheet is worked for controlling the growth of secondary recrystallization grains by working the sheets such that lines of less than 3.0 mm wide are formed on the surface of the steel sheet spaced apart at intervals of more than 5.0 mm so that the total effect is to produce worked and unworked regions alternatively arranged in lines across the steel sheet. Such working is effected by mechanical plastic working, local thermal treatment and by chemical treatment. The worked regions serve to control the growth of secondary recrystallization.

14 Claims, 12 Drawing Figures

HATCHED PORTION : PLASTIC WORKING REGION

BLANK PORTION : NOT WORKING REGION

HEAT ELEVATION STAGE OF A FINAL HIGH-TEMPERATURE ANNEALING: 900°C

METHOD OF PRODUCING GRAIN ORIENTED ELECTROMAGNETIC STEEL SHEET

BACKGROUND OF THE INVENTION

The present invention relates to a method of producing a sheet of grain-oriented electromagnetic steel, particularly a sheet of grain-oriented electromagnetic steel of such high grade that is high in terms of magnetic flux density and is small in term of watt loss.

A sheet of grain-oriented electromagnetic steel is produced by subjecting a sheet of hot-rolled silicon steel to more than one operations of cold rolling and more than one operations of annealing, so as to set the thickness of said sheet to a commercial standard, and then by subjecting said sheet to final high-temperature annealing at more than 1100° C for more than 10 hours, so as to get abnormal growth of such grain that has the grain texture of (110) [001] according to Miller indices (such growth being called as the "secondary recrystallization"). The so produced grain-oriented electromagnetic steel sheet has the easiest magnetization axis oriented in the rolling direction, thus having excellent magnetic properties, so that is is used mostly as the iron core of a transformer. As the material for the iron core, it is required to be as small as possible in watt loss, as the consumption of thermal energy decreases as the watt loss decreases. Hence, demand is increasing for sheets of grain-oriented electromagnetic steel of high grade under the present situation where power production cost is increasing, and the saving of power consumption is advocated in view of decreasing energy reserves.

In order to reduce watt loss of such steel, the following means are taken:

1. Increase the content of silicon;
2. Reduce the thickness of sheet;
3. Reduce the content of impurities to a minimum;
4. Raise the magnetic flux density by setting higher grain texture (110) [001] of grain; and
5. make smaller grain steel sheets Of the abovementioned means, higher magnetic flux density and smaller grain, can be secured only by the appropriate level of secondary recrystallization.

Even according to the prior art, it is theoretically concluded that the proper level of secondary crystallization can be secured by abnormal growth exclusively of crystal grain having the orientation (110) [001] by the presence of a dispersed phase consisting of such elements as selenium or stiblum and such compounds as sulfides, nitrides, selenides or antimonides (Examples: MnS; AlN; Se; Sb) as the inhibiter of normal grain growth in steel sheets before final high-temperature annealing, and also by a strong crystal texture produced in steel sheet.

However, in the practice of prior art, the methods for controlling the growth of secondary recrystallization grains results in poor control of normal grain growth, making it very difficult to obtain high grade grain-oriented electromagnetic steel sheets.

SUMMARY OF THE INVENTION

It is an object of the present invention to provide a method of producing a sheet of grain oriented electromagnetic steel of high grade by using a new step quite different from those of the prior art which was developed as a result of researches conducted on the phenomenon of secondary recrystallization. As a result of this step, steel sheets attaining the appropriate level of secondary recrystallization are characterized by higher magnetic flux density and smaller grains, thus resulting in great reduction in watt loss.

Another object of the present invention is to provide a method for producing a grain-oriented electromagnetic steel sheet on the basis of utilizing the known factor of secondary recrystallization controlling force to cause abnormal growth exclusively of grain having the grain texture (110) [001] and to control normal grain growth, and by additionally adopting a step developed from a completely new technical thought which involves controlling the growth of secondary recrystallization gain.

A further object of the present invention is to provide a method of producing a sheet of grain oriented electromagnetic steel of high grade with a small watt loss by applying as the step for controlling the growth of secondary recrystallization gain, one of the following three working steps: local mechanical plastic working, local thermal treatment and local chemical treatment.

The abovementioned objects and other objects according to the present invention can be achieved by producing a sheet of grain-oriented electromagnetic steel by subjecting sheet of grain-oriented electromagnetic steel containing silicon more than 4.5% to more than one operations of cold rolling and if necessary more than one operations of annealing, and also the step of subjecting to decarburization and final high-temperature annealing said sheet which is so cold-rolled and annealed into the thickness of a commercial standard, wherein applicants' improvement step involves the additional step of working said sheet so as to have the surface arranged alternately with the region of less than 3.0 mm wide worked for controlling the growth of secondary recrystallization grain (hereinafter referred to as the worked region unless spelled out) and the region of more than 5.0 mm wide left not worked for any such purpose (hereinafter referred to as the not worked region).

DESCRIPTION OF PREFERRED EMBODIMENTS

The following is detailed, concrete explanation of the present invention.

The starting material of the present invention is a steel produced by such a known steel-making process as steel produced using a converter, an electric furnace or the like, which, is fabricated into a slab by ingot making, slabbing or continuous casting, and further hot-rolled into hot-rolled coil. The hot-rolled steel sheet which is subjected to the method of the present invention, contains silicon less than 4.5%, and if necessary acid-soluble aluminum (Sol. Al) 0.010 to 0.050%, and sulfur 0.010 to 0.035%, but there is no restriction about the composition except for the amount of silicon, therefore, other components can be contained therein without limit. The hot-rolled coil is subjected to a combination of more than one operations of cold rolling and more than one operations of annealing, so as to make the thickness of a commercial standard (product). The steel sheet which is so worked into the thickness of the commercial standard, is subjected to decarburizing annealing in wet hydrogen atmosphere, and then to final high-temperature annealing at more than 1100° C for more than 10 hours. Thus, a grain-oriented electromagnetic steel sheet is produced.

The present invention relates to a method of producing said grain-oriented electromagnetic steel sheet, comprising working the surface of said steel sheet (both surfaces or either surface thereof) for controlling the growth of secondary recrystallization grain before the step of final high-temperature annealing, and the present invention is particularly concerned with the region worked for controlling the growth of secondary recrystallization grains. As for said working method, there may be used such methods as local mechanical plastic working, local thermal treatment and local chemical treatment.

The following is an explanation of the step of controlling secondary recrystallization grains by using local mechanical plastic working, local thermal treatment and local chemical treatment.

The special characteristics of the present invention achieved by local mechanical plastic working is set forth in the description below.

Figure 1:
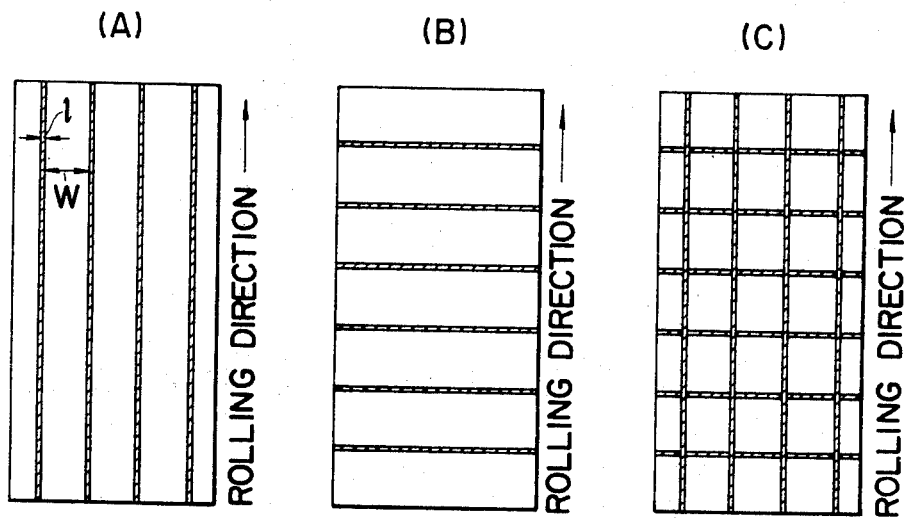
FIG. 1A, FIG. 1B and FIG. 1C are schematic sketches showing the arrangements of the plastic-worked region and the not-worked region in the practice of the method of the present invention.

A sheet of hot-rolled silicon steel containing silicon less than 4.5%, is subjected to the combination of cold rolling and annealing, so as to make the thickness of the steel comply with that of the commercial standard. Just before it is sent to the final high-temperature annealing step, said steel sheet is worked to form the plastic worked region of a certain width one by one with some distance on both surfaces or either one thereof in the rolling direction, or in the direction rectangular to the rolling direction (the direction of the width of the sheet) or in both directions. Referring to FIGS. 1 (A), (B) and (C), slant lines cover the mechanical plastic-worked region, and white blank represents the not so worked region. FIG. 1 (A) shows the case where the worked region is arranged parallel with the rolling direction; FIG. 1 (B) shows the case where the worked region is arranged in the direction rectangular to the rolling direction; and FIG. 1 (C) shows the case where the worked region is arranged both in the rolling direction and in the direction rectangular to the rolling direction, therefore, the so running directions forming the pattern of a lattice. Thus, the worked region and the not worked region are arranged alternately. As for the direction along which the worked region runs, it needs not be just the rolling direction or the direction rectangular to the same, but may be slanted at a certain angle to the sheet. As for the pattern of a lattice shown in FIG. 1(C), it may be also be varied as to contain squares, rectangles or lozenges. According to the present invention, said worked region should have the width ($l$) of less than 3 mm, and the not worked region should have the width (W) of more than 5 mm.

Figure 2:
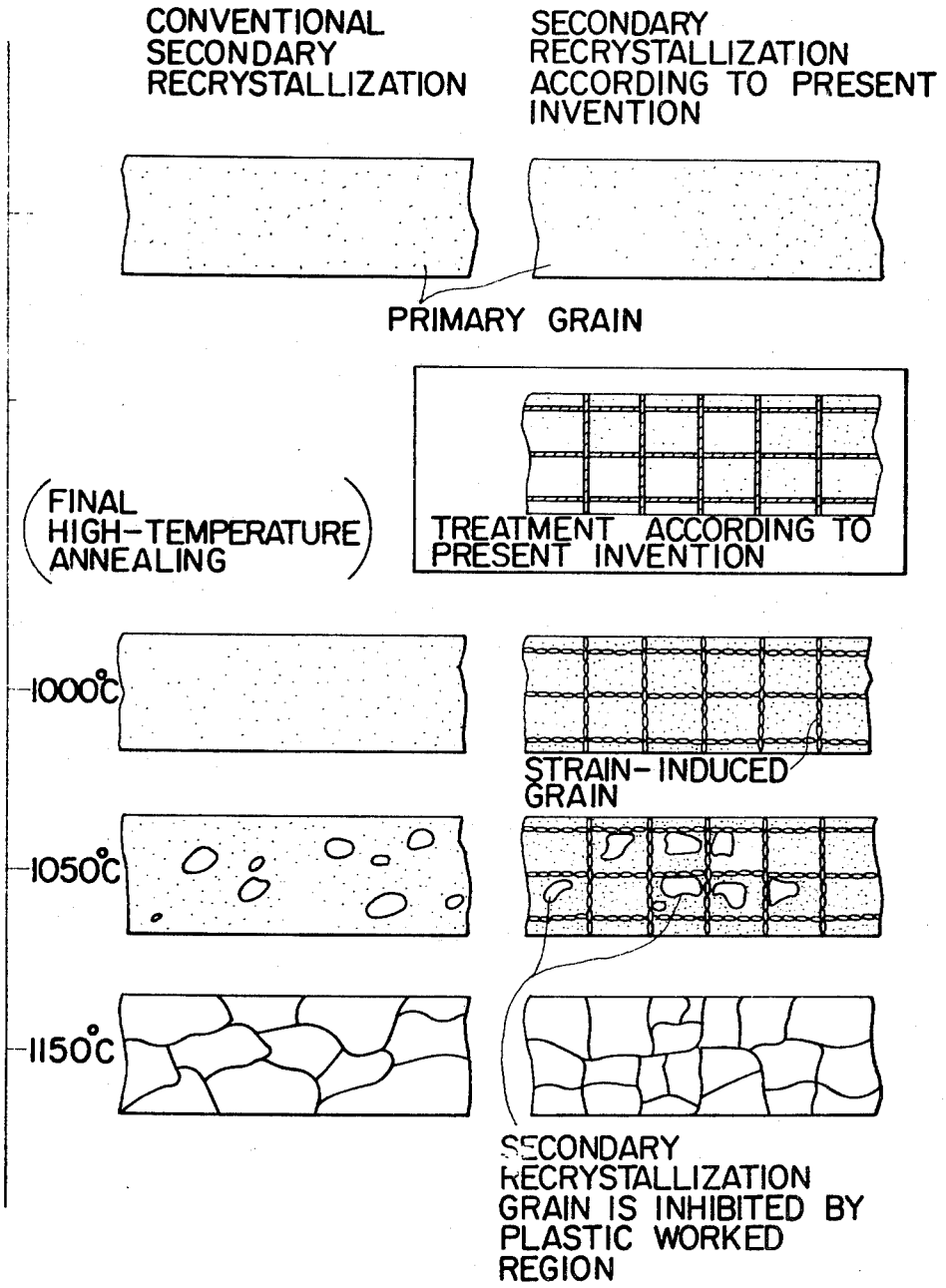
FIG. 2 presents a schematic sketch showing a comparison in the behavior of secondary recrystallization between the prior art methods and the method of the present invention.

As examples of processes of mechanical plastic working, there are available such means as a process using step rolls at a certain distance between them, the surface of which is provided with concave parts; a process of scratching the surface of the sheet with scribers; and a process of shot peening (or grit peening) only the worked region, the other part being covered so as to be free from such working. In order to produce a sheet of flat surface, shot peening of only the worked region and scratching the surface of the steel with scribers, are preferred. Using FIG. 2 showing the schema of secondary recrystallization, we will explain, how said mechanical working according to the present invention, works in controlling the normal grain growth, while leaving exclusively a crystal grains having the grain texture (100) [001] to grow. As mentioned above, FIG. 2 presents a schema showing the behavior of secondary recrystallization taking place on the steel sheet having the region subjected to the mechanical working according to the present invention for comparison with that of secondary recrystallization taking place on a control which is not so worked. Normally speaking, secondary recrystallization starts at about 1050° C and finishes at about 1150° C. In the case where the working according to the present invention is applied, the growth of grain starts in the worked region at a temperature of less than 1,000° C due to strain-induction prior to the production of secondary recrystallization grain; thus, the worked region functions to inhibit the growth of secondary recrystallization grain produced in the unworked region. That is, the grain produced closer to the grain texture (100) [001] grows over the inhibiting boundary, but the grain produced away from said orientation is inhibited by the worked region from growing.

Figure 3:
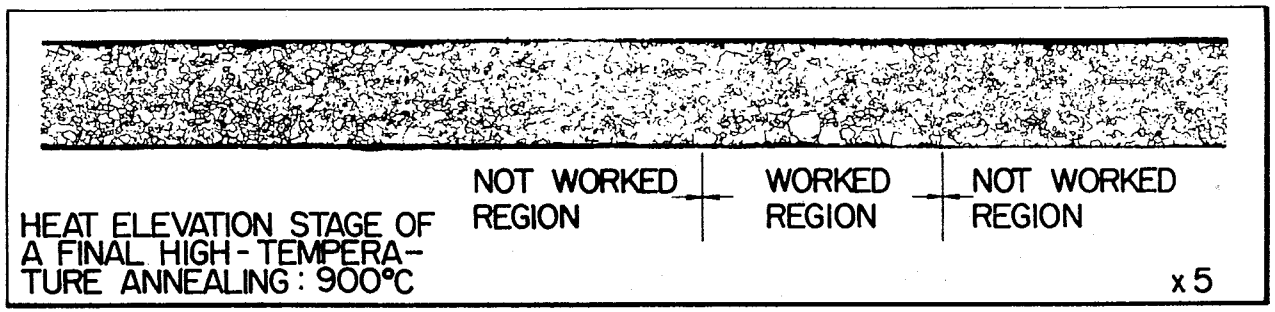
FIG. 3 presents a photograph showing strain-induced grain produced in the plastic-worked region according to the present invention.

The working according to the present invention functions by exerting a new force to control the growth of secondary recrystallization grain, thereby making the appropriate degree of secondary recrystallization, thus making it possible to produce a sheet of grain-oriented electromagnetic steel of high magnetic flux density with product grain size being so small as to reduce watt loss. The application of this phenomenon to commercial production is explained as follows:

In case the material steel sheet is worked in the shot-peening process such that the so worked region is 1.2 mm wide and the unworked region is 14 mm wide and where such regions arranged alternately to follow the pattern of a lattice as shown in FIG. 1 (C), a part thereof, where the growth of crystal grain is seen, is formed due to strain induction in the so worked region, as shown in FIG. 3. This occurs at about 900° C during the heat elevation stage of the final high-temperature annealing. If the temperature further rises, secondary recrystallization takes place also in the not worked region at about 1050° C, but the so produced grain is inhibited from growing by the strain-induced grain produced in the so worked region.

Figure 4:
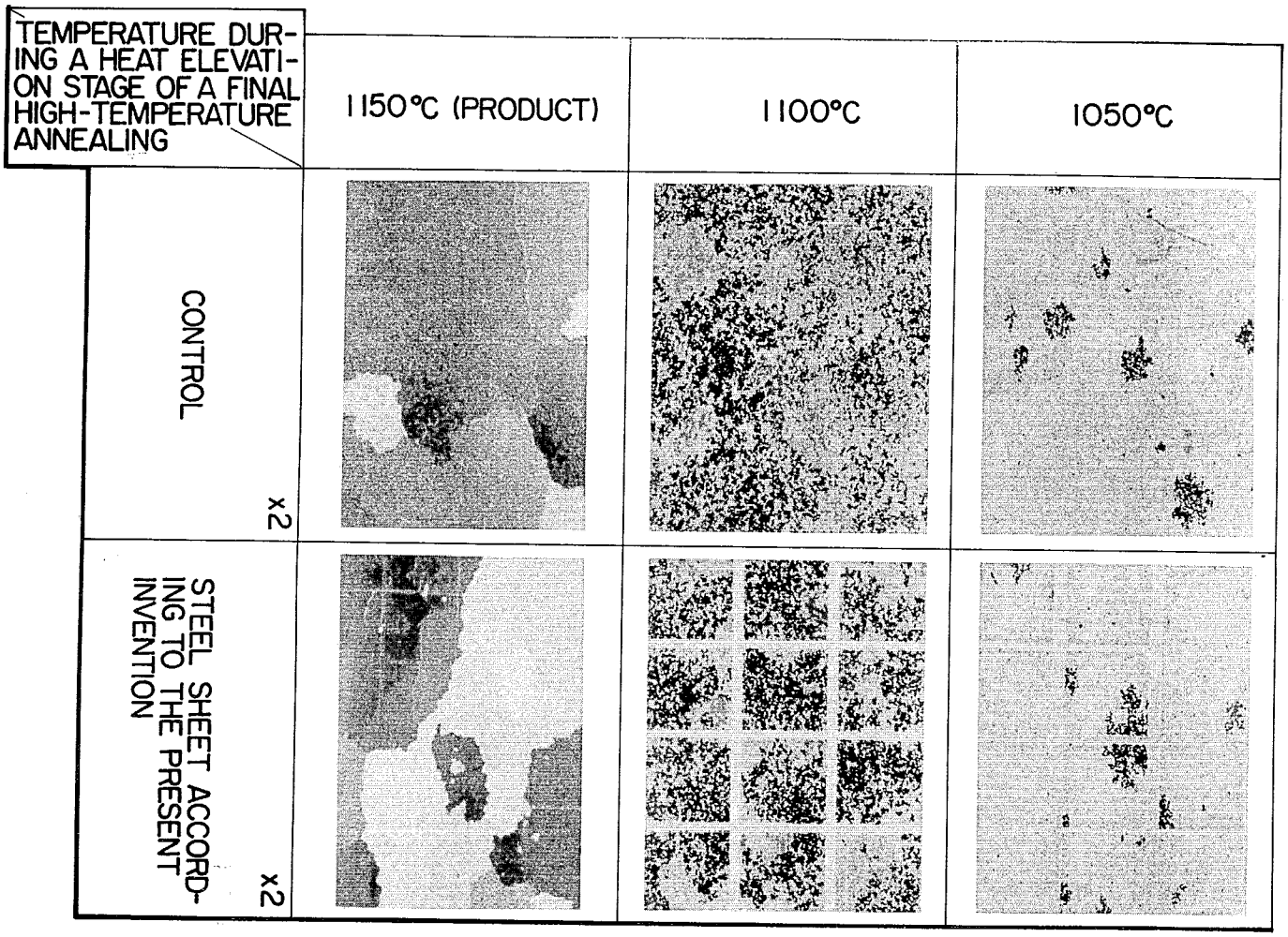
FIG. 4 presents a photograph of the texture of a steel sheet to show the behavior of the plastic-worked region according to the present invention in controlling the growth of secondary recrystallization grain at an elevated temperature in the final high-temperature annealing step for comparison with a control.

It can be understood from FIGS. 3 and 4, that the working of the surface of a steel sheet according to the present invention brings about the appropriate degree of secondary recrystallization, as a result of a inhibiting the effect of the strain-induced grain produced in addition to the effect of the force in inhibiting secondary recrystallization according to the prior art, which effects bring about a strong crystal texture.

As may be understandable from the abovementioned, the purpose of the plastic working according to the present invention is to bring about a strain-induced grain growth at the secondary crystallization temperature, say, less than 1000° C with a minimum amount of working. Such working according to the present invention is applied to the surface of steel sheet which is subjected to continuous decarburizing annealing applied ordinarily prior to the final high-temperature annealing step.

As mentioned in the explanation of FIG. 2, secondary recrystallization grain starts appearing in the unworked region, and grows as the temperature rises until it eats up the grain produced in the plastic-worked region at the final stage of the final high-temperature annealing step. However, the production of secondary recrystallization grain is inhibited by even a small plastic working; therefore, care must be take in the working step according to the present invention to leave the unworked region alone after the working step.

Figure 5:
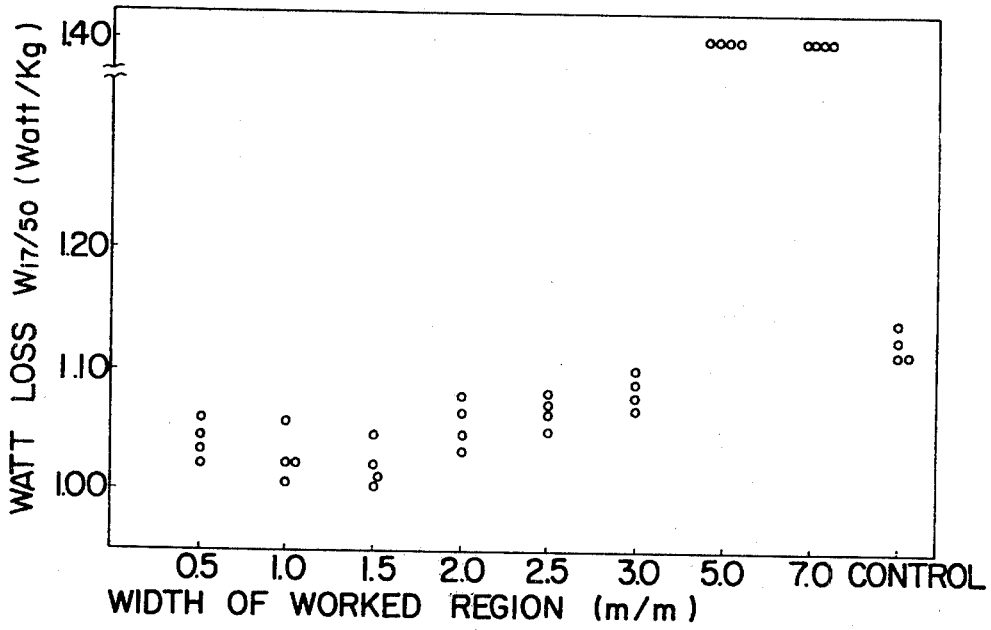
FIG. 5 presents a graph showing the relation between the width of the plastic-worked region and watt loss.
Figure 6:
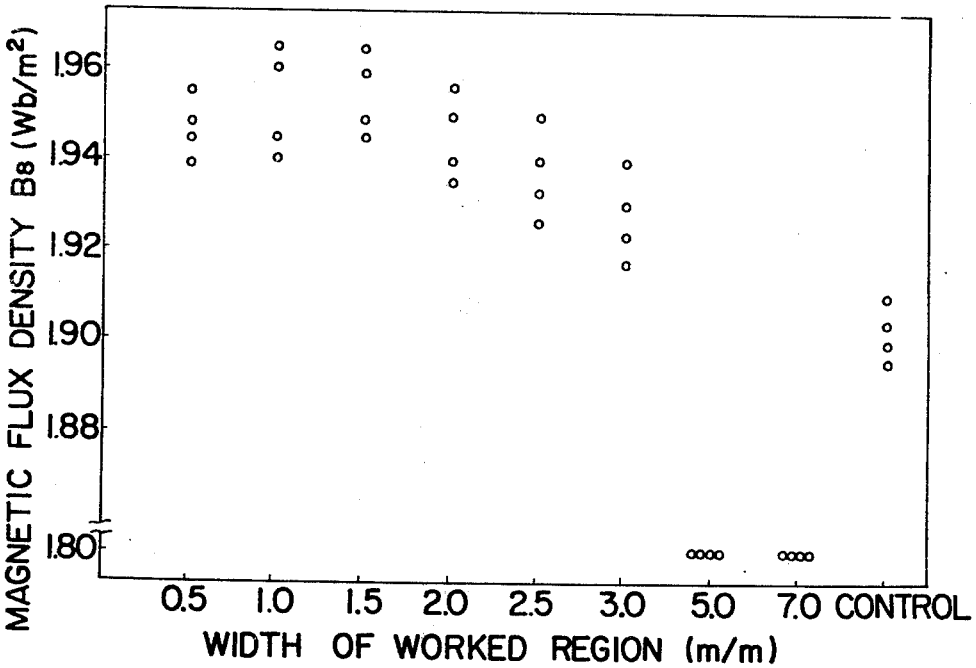
FIG. 6 presents a graph showing the relation between the width of the plastic-worked region and magnetic flux density.

The reason of setting the width of the plastic-worked region at 3.0 mm maximum is, as follows:

Tests were conducted for appropriate widths for said plastic worked region in the following manner: The respective widths of 1.0, 1.5, 2.0, 2.5, 3.0, 5.0 and 10.0 mm of a region worked by shot peening and the width of the unworked region in each case was 10 mm arranged alternately as shown in FIG. 1 (A), on the surface of a steel sheet of 0.30 mm thick just before final high-temperature annealing. The relations between such widths of the region worked by shot peening after final high-temperature annealing and watt loss and magnetic flux density, are shown in FIGS. 5 and 6 for comparison with the control which is not so worked. The shot peening conditions are: Material, shot No. 30 cast iron; shot projection speed: 45 m/sec.; shot amount: 500 kg/min. $m^2$; shot time: 5 sec. The coverage of the not worked region of the steel sheet was PVC painting. Thus, there was formed a roughness of 5 $\mu$ on the surface of the worked region.

As understandable from FIGS. 5 and 6, in cases where the width of the plastic-worked region is over 3.0 mm, the magnetic flux density gets lower, and as fine grain having other grain texture than (110) [001] which is not eaten up by the secondary recrystallization grain stays in the worked region, it causes the wattage loss to increase.

Figure 7:
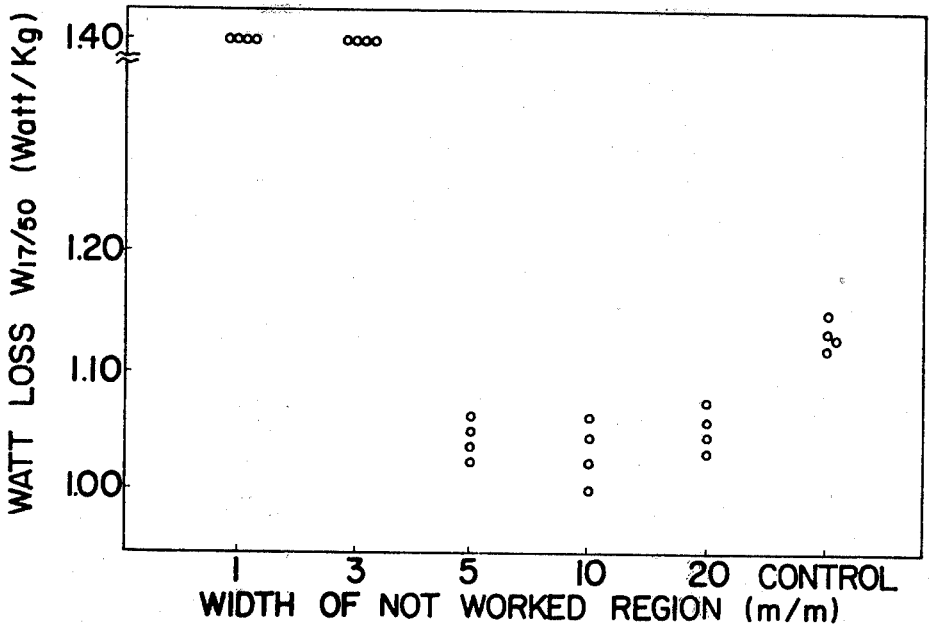
FIG. 7 presents a graph showing the relation between the width of the not-worked region and watt loss.
Figure 8:
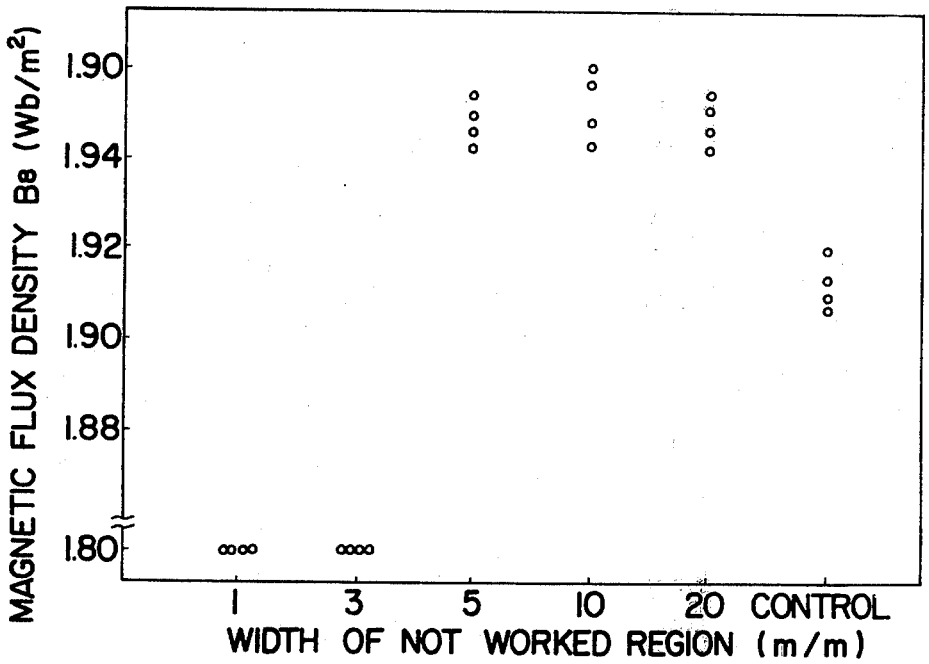
FIG. 8 presents a graph showing the relation between the width of the not-worked region and magnetic flux density.

On the other hand, in cases where the width of said region is less than 3.0 mm, the wattage loss decreases, and the magnetic flux density becomes higher. Therefore, the width of the worked region is limited to less than 3.0 mm. As for minimum width of said region, it can be made lower until the region stops functioning, but the minimum is set at 0.05 mm, preferably 0.1 mm. The reason for setting the width of the unworked region at 5 mm minimum is that tests were conducted for appropriate widths regarding the worked said region in the following manner: The respective widths of 1, 3, 5, 10 and 20 mm of the unworked region and a width of 1.0 mm in each case for the region worked by shot peening, were arranged alternately, as shown in FIG. 1 (A), on the surface of a steel sheet of 0.30 mm thick just before the final high-temperature annealing step. The shot peening conditions were the same as mentioned above. The relationship between such widths of the unworked region after final high-temperature annealing and watt loss and magnetic flux density, are shown in FIGS. 7 and 8. As understandable from these figures, in the case of the width of the not worked region being less than 5 mm, the magnetic flux density becomes lower, and wattage loss increases. This is perhaps because the secondary recrystallization grain becomes lower in granular number than the grain produced by strain induction in the plastic-worked region, making secondary recrystallization unstable. On the other hand, in the case where the width of the unworked region is more than 5.0 mm, the magnetic flux density becomes higher, and wattage loss decreases.

As for the maximum width of the unworked region, it is preferred to be set about 25 mm, as too great a width thereof may diminish its effect.

Once the abovementioned conditions covering the plastic worked region and the unworked region are satisfied, there is no difference in the effect of wattage loss decrease in respect to the variety of ways of arranging these two regions. The following Table 1, shows the magnetic properties of the steel sheet of 0.30 mm thick which was subjected to shot peening to form the worked region of 1.0 mm wide arranged alternately with the not worked region of 10 mm wide to follow the patterns (A), (B) and (B) of FIG. 1, and which then was subjected to the final high-temperature annealing step:

Table 1

| Arrangement Pattern | Watt loss $W_{17/50}$ (Watt/kg) | Magnetic flux density $B_{10}$ (wb/m) |
|---|---|---|
| Control (not worked) | 1.22 | 1.89 |
| Sheet worked according to the present invention | | |
| FIG. 1(A) | 1.04 | 1.95 |
| FIG. 1(B) | 1.05 | 1.94 |
| FIG. 1(C) | 1.02 | 1.95 |

In comparison with the control, the steel sheets which were so worked according to the present invention, as to have respectively the patterns (A), (B) and (C), have higher magnetic flux density and smaller watt loss.

In order to produce strain-induced grain as the object of the present invention, such workings as shot peening or scratching are preferred to secure the flatness of the furnace. Whether the steel sheet is worked on both surfaces or either surface, does not matter from the standpoint of watt loss decrease, but the working on one surface is preferred in view of the consumption of smaller amount of time and labor.

An explanation of the control of the growth of secondary recrystallization grain as a result of local thermal treatment according to the present invention is in order and the special characteristics of said treatment are as follows:

During or after the final cold rolling and before the final high-temperature annealing, the steel sheet has both surfaces or one surface provided with a region of less than 3.0 mm wide produced as a result of local heat treatment at more than 600° C and with an unworked region of more than 5.0 mm, these regions being arranged alternately so as to follows the patterns as explained in the above paragraph concerning local mechanical plastic working, that is, the same patterns as mentioned in FIGS. 1 (A), (B) and (C).

As for the method of local heat treatment at more than 600° C, there are available infrared ray bulbs of high irradiation capacity, LASER ray apparatus and electron beams which are used to irradiate selectively the to-be-worked region. The greater the irradiation therefrom, the shorter the irradiation time required for the operation of an apparatus added to or independent from the equipment for practising the method according to the present invention, hence the preference to a greater irradiation of thermal rays.

In the case of using local thermal treatment the so worked region functions as a force of inhibition developed as the special characteristic of the present invention, ensuring an appropriate degree of secondary recrystallization, thus making for a higher magnetic flux density and a smaller grain size of the product steel sheet, resulting in a smaller watt loss in the same way as mentioned in the case of the local plastic working. More specifically speaking, local thermal treatment causes an area in which the normal grain having a different orientation from that of the grain outside the worked region grows, to form within the so worked region, which area inhibits the growth of secondary recrystallization grain produced in the unworked region. In this case, the crystal grain having a grain texture closer to (110) [001] is capable of growing beyond the inhibiting boundary, thus controlling the growth of the grain having the grain texture for away from (110) [001].

As mentioned above, local mechanical plastic working and local thermal treatment have the same effects constituting the foundation of the special characteristic of the present invention, but are quite different in the manner of controlling recrystallization; that is, while the former utilizes the growth of strain-induced grain, the latter utilizes the quality of steel sheet according to which, if subjected to an additional thermal pretreatment at more than 600° C in a thermo decurburizing atmosphere before decurburization, the steel sheet tends to lose its inherent capacity to develop secondary recrystallization.

The reason for specifying the temperature to be more than 600° C is that at less than 600° C, primary recrystallization will take place not enough to support the effect of the present invention, or even if it does, it will require so long time as to make itself impracticable. As for the maximum of the temperature used in the heat treatment, it is not specified, but such temperature may be raised up to the full capacity of the treating equipment. As the effect of such thermal pre-treatment continues, it is practical to additionally apply light cold rolling to correct the deformation of the steel sheet produced by the heat strain due to the local thermal treatment.

Figure 9:
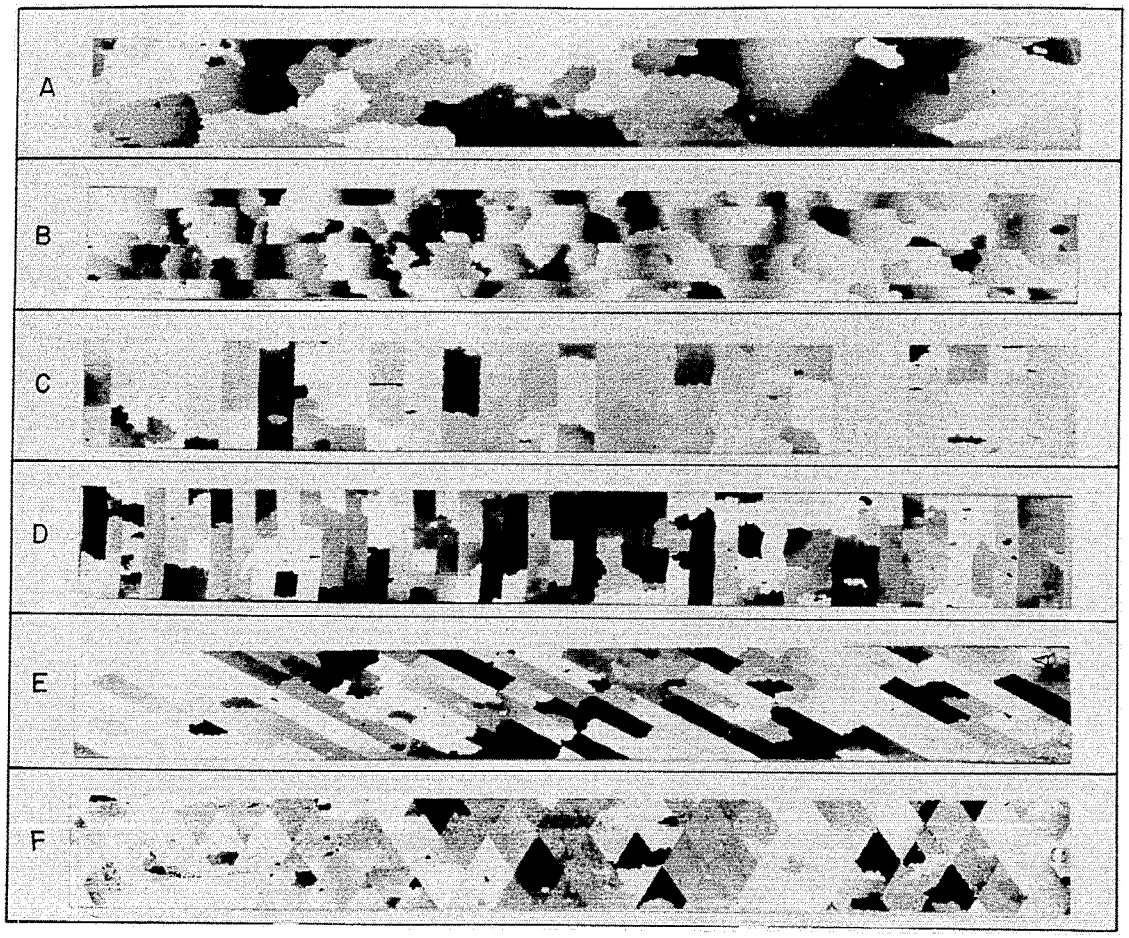
FIG. 9 presents photograph showing various arrangments between the worked region and the not-worked region, the behaviors of the worked region in controlling the growth of secondary recrystallization grain, in the case where the surface of the steel sheet is subjected to local heat treatment according to the present invention.

FIG. 9 shows a case of controlling the growth of secondary recrystallization grain as a result of local thermal treatment of the worked region as compared with a control which is not worked.

The conditions on which the local thermal treatment was applied as follows: Silicon steel containing carbon 0.048%, silicon 2.92%, sulfur 0.026%, acid-soluble aluminum 0.030%, was bloomed and hot-rolled to the thickness of 2.3 mm, subjected to continuous annealing for 2 minutes at 1130° C, pickled and then cold-rolled to a thickness of 0.34 mm. The cold-rolled steel sheet was irradiated with a beam of 38 KV, in acceleration voltage and of 3mA in beam current at a scanning speed of 2m/min. by use of an electron beam apparatus. In this case, the width of irradiation was about 1 mm. Then the steel sheet was rolled to the thickness of 0.30 mm, washed in oil elimination, subjected to decurburizing annealing in wet hydrogen atmosphere at 850° C for 4 minutes, painted with a separator for annealing, and then subjected to final high-temperature annealing at 1200° C for 20 hours. As understandable from FIG. 9, the working according to the present invention proves effective in inhibiting the growth of secondary recrystallization grain.

Table 2 shows the methods of arrangement of the treated region and the not treated region in the samples (B) to (F) shown in FIG. 9.

Table 2

| Sample | Arrangement |
|---|---|
| A | Control (not irradiated) |
| B | In the rolling direction with an interval of 10 mm |
| C | In the direction rectangular to the rolling direction with an interval of 7 mm |
| D | In the direction rectangular to the rolling direction with an interval of 5 mm |
| E | In the direction of 60° against the rolling direction with an interval of 5 mm |
| F | In the directions crossing each other each running at 45° against the rolling direction with intervals of 5 mm between adjacent rays running in parallel |

The object of local thermal treatment according to the present invention is to cause normal grain growth in the so worked region, such growth having a different grain texture from that of the growth taking place around said region, thereby adding the abovementioned force of inhibition to the normally produced force for inhibiting recrystallization, so as to ensure an appropriate degree of recrystallization. In order to attain said object, grain produced in said region should be eaten up by the secondary recrystallization grain produced and grown in the unworked region at the final stage of the final high-temperature annealing step. It is found necessary to meet the abovementioned conditions that the so worked region should be made less than 3.0 mm wide, and the not worked region more than 5.0 mm wide, as in the case of local mechanical plastic working mentioned above. The same effect can be obtained between the treatments of both sides of the samples and of one side thereof, but when taking labor into consideration, the treatment of one side is preferred.

Another method of working the surface of the steel sheet is by local chemical treatment to control the growth of recrystallization grain.

The special characteristics of the chemical treatment are as follows:

After cold rolling or decarburizing annealing prior to the final high-temperature annealing step, the surface of a steel sheet is diffusely injected with a grain growth resistant material to form a worked region having a width of less than 3.0 mm, such region being arranged alternately with the unworked region having a width of more than 5.0 mm. As for the pattern of alternate arrangement of the region subjected to said local chemical treatment and the unworked region, it is made in the same manner as shown in FIGS. 1 (A), (B) and (C) to represent said local mechanical plastic working.

In said local chemical treatment whereby a grain growth resistant material is diffused or impregnated onto the steel surface, there can be used, such resistant material as a sulfide (examples: MnS, CrS. CuS), a nitride (examples: AlN, $V_3N_4$), an oxide, (example: $Al_2O_3$), a selenide or an antimonide, or an element as a component of any of these compounds, phosphoric acid or a phosphate. Said resistant material in the form of a solution or a slurry is painted on said steel sheet after cold rolling or decarburizing annealing, and dried and subjected to thermal treatment for diffused injection. When painting said resistant to the cold-rolled steel sheet, thermal treatment for diffused injection can be applied at the same time with decarburizing annealing. Final high-temperature annealing can be applied concurrently with said thermal treatment for diffused injection. As for the method of painting said resistant, high-speed printer can be used effectively for high-speed application to steel sheet in desired patterns of arrangement of the worked region as well as in desired width thereof.

As a result of said local chemical treatment, the so worked region functions by exercising a new force for controlling the growth of secondary recrystallization grain which constitute the special characteristic of the present invention. Such force ensures an appropriate degree of recrystallization which in turn produces a steel having high magnetic flux density and a small-sized grain, which reduces watt loss, in the same manner as in the previously described methods. The difference from the latter two workings, however, lies in the behavior of the worked region in controlling recrystallization.

In the case of the local chemical treatment, the worked region loses its inherent capacity for secondary recrystallization by diffusion of said resistant material; therefore, normal grain growth takes place without secondary recrystallization, thus controlling the growth of secondary recrystallization grain produced in the not worked region.

Figure 10:
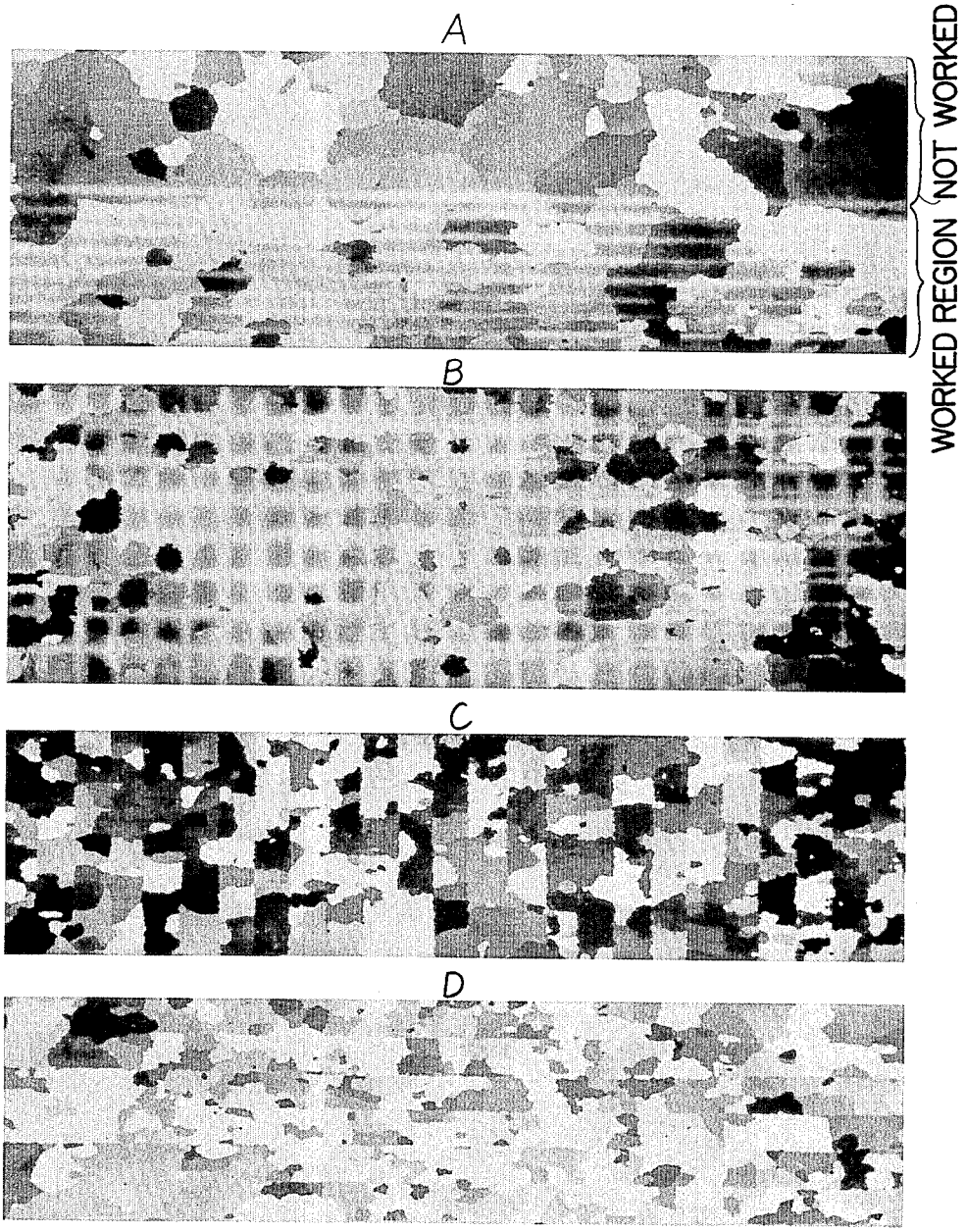
FIG. 10 presents photographs showing various arrangements between the worked region and the not-worked region, the behaviors of the worked region in controlling the growth of secondary recrystallization grain, in the case where the surface of the steel sheet is subjected to local chemical treatment.

FIG. 10 shows the behavior of the so worked region in controlling the growth of secondary recrystallization grains. The conditions of the treatment, the results of which is show in FIG. 10 are as follows:

A sheet of silicon steel containing carbon 0.046%, silicon 2.90%, sulfur 0.035%, acid-soluble aluminum 0.030%, was bloomed and hot-rolled to the thickness of 2.3 mm. The hot-rolled sheet was annealed at 1130° C continuously for 2 minutes, pickled and cold-rolled to the thickness of 0.30 mm. The cold rolled steel sheet was painted in lines with a solution of $Na_2HPO_4 . 12H_2O$ 50g, 75% $H_3PO_4$ 15cc and $H_2O$ 50 cc or a slurry of ZnS 10g - $H_2O$ 20cc, and desiccated in the furnace at 500° C for about 20 seconds, each such line being as wide as about 1 mm. Then, said steel sheet was subjected to decarburizing annealing in wet hydrogen atmosphere for 4 minutes. It was painted further with a separator for annealing, and subjected to final high-temperature annealing at 1,200° C for 20 hours.

As understandable from FIG. 10, said chemical treatment inhibits the growth of secondary recrystallization grain, resulting in making finer grain. The following table presents the methods of arrangement of the worked region and the unworked region according to the samples A to D shown in FIG. 10:

Table 3

| Sample | Treating solution | Arrangement |
|---|---|---|
| A | $Na_2HPO_4 . 12H_2O$:50g<br>75%$H_3PO_4$:15cc<br>$H_2O$:50cc | Upper half : Not worked<br>Lower half : In lines parallel with the rolling direction at an interval of 5 mm |
| B | Same as above | In lines parallel with and rectangular to the rolling direction at an interval of 10 mm |
| C | ZnS:10g<br>$H_2O$:20cc | In lines rectangular to the rolling direction at an interval of 10 mm |
| D | Same as above | In lines parallel with the rolling direction at an interval of 10 mm |

The object of local chemical treatment by diffusely injecting a resistant to grain growth of secondary recrystallization grain, according to the present invention is to cause normal grain growth in the worked region, so that the so produced force of inhibition, in addition to the normally produced force for inhibiting recrystallization, ensures an appropriate degree of recrystallization. In order to attain said object, grain produced in said region should be eaten up by the secondary recrystallization grain produced and grown in the unworked region, at the final stage of the final high-temperature annealing step. It is found necessary to meet the above-mentioned conditions that the so worked region should be made less than 3.0 mm wide, and the not worked region more than 5.0 mm wide, as in the case of local mechanical plastic working mentioned above. The same effect can be obtained between the treatments of both sides of the steel sheet and of one side thereof, but when taking into consideration labor consumed in doing the treatment of both sides, the treatment of one side is preferred.

EXAMPLE 1

A sample sheet of hot-rolled steel containing carbon 0.050%, silicon 3.10% sulfur 0.027%, and acid-soluble aluminum 0.030%, was subjected to annealing at 1170° C for 1.5 minutes, and cold-rolled to a thickness of 0.30 mm, and decarburized at 840° C in a wet hydrogen atmosphere for 5 minutes. The surface of the sample was then subjected to shot peening so as to have such arrangement of the so worked regions of 1.0 mm and 1.5 mm wide and the unworked region of 7.0 mm wide as shown in FIG. 1 (A). It was further subjected to final high-temperature annealing at 1150° C for 20 hours, so that magnetic properties were obtained as shown in Table 4.

The conditions of shot peening are as follows: shot No 30 cast iron is employed; shooting speed: 80 m/sec: shot weight: 300 kg/min. $m^2$; shooting time: 3 seconds.

The coverage of the unworked region was accomplished with a sheet steel used for wear-resisting tool manufacture.

Table 4

| Shot Peening | | | | |
|---|---|---|---|---|
| Worked region width(mm) | Not worked region width(mm) | Both sides or one side | Watt loss $W_{17/50}$ (Watt/kg) | Magnetic flux density $B_8$ (Wb/m²) |
| 1.0 | 7.0 | Both sides | 1.00 | 1.96 |
| 1.0 | 7.0 | One side | 1.02 | 1.95 |
| 1.5 | 7.0 | Both sides | 1.03 | 1.95 |
| 1.5 | 7.0 | One side | 1.04 | 1.95 |
| Control (Not Worked) | | | 1.21 | 1.90 |

Compared with the control which was not worked, but which were the same in other conditions, the samples which were subjected to shot peening to obtain lower watt loss and higher magnetic flux density, as shown in Table 4.

EXAMPLE 2

A sample sheet of hot-rolled steel containing carbon 0.040%, silicon 3.20%, sulfur 0.035%, was cold-rolled to a thickness of 0.80 mm, and annealed at 820° C for 3 minutes. It was further cold-rolled to a thickness of 0.30 mm, and decarburized at 840° C in a wet hydrogen atmosphere for 5 minutes. Then, the surface of said steel sheet was worked by shot peening such that the worked region was 1.2 mm wide and unworked region was 10 mm wide which arrangements are shown in FIG. 1 (A), (B) and (C). It was further subjected to a final high-temperature annealing at 1150° C in a hydrogen atmosphere for 20 hours, so that magnetic properties were obtained as shown in Table 5.

The conditions of shot peening were: a shot No. 30 cast iron grit was employed; shooting speed: 75 m/sec; shot amount: 500 kg/min.m²; shooting time: 2 seconds. The coverage of the unworked region was painting with PVC paint.

Table 5

| Shot Peening | | | | |
|---|---|---|---|---|
| Arrangement | | Worked (both sides or one side) surface | Watt loss $W_{17/50}$ (watt/kg) | Magnetic flux density $B_8$ (Wb/m²) |
| (A) | L orientation | Both sides | 1.10 | 1.93 |
| (B) | C orientation | Both sides | 1.12 | 1.91 |
| (C) | Lattice | Both sides | 1.11 | 1.93 |
| (A) | L orientation | One side | 1.13 | 1.90 |
| (B) | C orientation | One side | 1.14 | 1.90 |
| (C) | Lattice | One side | 1.12 | 1.92 |
| Control (not worked) | | | 1.27 | 1.86 |

Compared with the control which was not worked, all the samples which were subjected to shot peening according to the present invention, have a smaller watt loss and higher magnetic flux density irrespective of the various arrangements of the worked region and the unworked region.

EXAMPLE 3

Samples of hot-rolled steel containing carbon 0.052%, silicon 3.20%, and acid-soluble aluminum 0.030% were annealed at 1.170° C for 1.5 minutes, cold-rolled to a thickness of 0.30 mm and decarburized at 840° C in a wet hydrogen atmosphere for 5 minutes. The surface of said samples were subjected to plastic working for the arrangement of the worked region as shown in FIG. 1 (B) in the following three ways: First way: a region 0.8 mm wide was subjected to shot peening alternately with an unworked region of 10.0 mm wide; second way: a region was subjected to a scribing 0.4 mm wide alternately with an unworked region of 10.0 mm wide; third manner: a 2 u-deep concave region of 1.0 mm wide alternately with an unworked region of 10 mm wide was effected, said worked region being made by printing with an upper roll having a convex of 1.0 mm wide and of 20 $\mu$ high.

The so worked samples were subjected to final high-temperature annealing at 1150° C in hydrogen atmosphere for 20 hours. The magnetic properties are shown in Table 6.

Table 6

| Worked by | Watt loss $W_{17/50}$ (Watt/kg) | Magnetic flux density $B_8$ (Wb/m²) |
|---|---|---|
| Shot peening | 1.01 | 1.96 |
| Scribing | 1.03 | 1.94 |
| Cold rolling | 1.06 | 1.93 |
| Control (not worked) | 1.21 | 1.89 |

Compared with the control which was not worked, the samples worked by shot peening, scribing and cold rolling according to the present invention are characterized by possessing higher magnetic flux density and smaller watt loss.

EXAMPLE 4

A sample sheet of silicon steel containing carbon 0.046%, silicon 2.90%, sulfur 0.025% and acid-soluble aluminum 0.028% was bloomed and hot-rolled to the thickness of 2.3 mm, annealed at 1130° C continuously for 2 minutes, pickled and cold-packed to the thickness of 0.35 mm. Said cold-rolled sheet was irradiated with an electron beam under the following conditons: accelerating voltage: 38 KV, beam current: 3 mA, scanning speed: 2m/min. and irradiation width: 1.5 mm. Scanning was done in a direction rectangular to the rolling direction with an interval of 5 mm. Said sheet was further rolled to a thickness of 0.29 mm, and washed by oil, and subjected to decarburizing annealing at 850° C in a wet hydrogen atmosphere for 4 minutes. Said steel sheet was painted with a separator for annealing, and subjected to final high-temperature annealing at 1200° C for 20 hours. As a result, said steel sheet has the magnetic properties shown in Table 7.

Table 7

| | Control (not worked) | | Sample worked as mentioned above | |
|---|---|---|---|---|
| | Magnetic flux density $B_8$ (Wb/m²) | Watt loss $W_{17/50}$ (Watt/kg) | Magnetic flux density $B_8$ (Wb/m²) | Watt loss $W_{17/50}$ (Watt/kg) |
| A | 1.90 | 1.16 | 1.93 | 1.11 |
| B | 1.90 | 1.16 | 1.95 | 1.05 |
| C | 1.92 | 1.10 | 1.94 | 1.07 |
| D | 1.92 | 1.09 | 1.96 | 1.02 |
| E | 1.91 | 1.10 | 1.94 | 1.04 |

As shown in the above table the samples which were worked have smaller watt losses and higher magnetic flux densities.

EXAMPLE 5

A sample sheet of silicon steel having the same content as the sample sheet of Example 4 was worked in the same manner as mentioned in Example 4, and cold-rolled to a thickness of 0.30 mm. Said cold-rolled steel sheet was exposed to an irradiation of electron beams under the following conditions: accelerating voltage: 38 KV; beam current: 3mA; scanning speed: 2m/min.; and irradiation width: 2 mm.

Irradiation was made in two directions: In a direction rectangular to the rolling direction with an interval of 10 mm; and in the rolling direction with an interval of 10 mm. After said irradiation, said steel sheet was subjected to decarburizing annealing at 850° C in a wet hydrogen atmosphere for 4 minutes, then painted with a separator for annealing, and further annealed at 1200° C for 20 hours. The result is shown in Table 8:

Table 8

| | Control (not worked) | | Direction rectangular to rolling direction | | Rolling direction | |
|---|---|---|---|---|---|---|
| | $B_8$ (Wb/m²) | $W_{17/50}$ (W/kg) | $B_8$ (Wb/m²) | $W_{17/50}$ (W/kg) | $B_8$ (Wb/m²) | $W_{17/50}$ (W/kg) |
| A | 1.71 | 1.14 | 1.94 | 1.07 | 1.93 | 1.11 |
| B | 1.92 | 1.18 | 1.95 | 1.06 | 1.94 | 1.12 |
| C | 1.92 | 1.16 | 1.96 | 1.04 | 1.94 | 1.10 |
| D | 1.94 | 1.15 | 1.96 | 1.05 | 1.95 | 1.10 |
| E | 1.93 | 1.15 | 1.95 | 1.06 | 1.94 | 1.11 |

It can be understood from the above table that the so worked steel sheet has a smaller watt loss and higher magnetic flux density.

EXAMPLE 6

A sample sheet of silicon steel containing carbon 0.048%, silicon 2.95%, sulfur 0.026% and acid-soluble aluminum 0.027% was bloomed and hot-rolled to the thickness of 2.3 mm. Then, the cold-rolled steel sheet was subjected to annealing at 1130° C continuously for 2 minutes, pickled and cold-rolled to a thickness of 0.30 mm. Said cold-rolled steel sheet was painted with a solution of 85% $H_3PO_4$ or $Na_2HPO_4$ 50g and 85% $H_3PO_3$ 20 cc and $H_2O$ 50 cc in lines each of about 1 mm wide as mentioned in Table 9 below; and after desiccated at a furnace temperature of 500° C for 20 seconds, it was subjected to decarburizing annealing at 850° C in a wet-hydrogen atmosphere for 4 minutes. Then, said sample was painted with a separator for annealing, and subjected to final high-temperature at 1200° C for 20 hours.

The so worked steel sheet has magnetic properties as shown in Table 9.

Table 9

| Treating solution | Magnetic flux density $B_8$ (Wb/m²) | Watt loss $W_{17/50}$ (Watt/kg) | Arrangement |
|---|---|---|---|
| Not treated | 1.90 | 1.23 | control |
| 85% $H_3PO_4$ | 1.94 | 1.08 | In lines running rectangular to the rolling direction with an interval of 10 mm |
| | 1.93 | 1.18 | In lines running parallel with the rolling direction with an interval of 10 mm |
| | 1.93 | 1.17 | In lines of two kinds one running rectangular to the rolling direction with an interval of 10 mm and the other running parallel with the rolling direction with an interval of 10 mm |
| $Na_2HPO_4 \cdot 12H_2O$:50g<br>85% $H_3PO_4$:20cc<br>$H_2O$:50cc | 1.94 | 1.98 | In lines running rectangular to the rolling direction with an interval of 10 mm |
| | 1.94 | 1.13 | In lines running parallel with the rolling direction with an interval of 10 mm |
| | 1.93 | 1.19 | In lines of two kinds one running rectangular to the rolling direction with an interval of 10 mm and the other running parallel with the rolling direction with an interval of 10 mm |

As can be understood from the above table, the worked steel sheets have a smaller watt loss and a higher magnetic flux density.

EXAMPLE 7

A sample sheet of silicon steel containing carbon 0.046%, silicon 2.90%, sulfur 0.025% and acid-soluble aluminum 0.03% was bloomed and hot-rolled to a thickness of 2.3 mm. Then, said sample was annealed at 1130° C continuously for 2 minutes, pickled, and then cold-rolled to the thickness of 0.28 mm. Said cold-rolled steel sheet was painted with a solution of $K_2S$ 5g and $H_2O$ 62.5 cc or a solution of $Na_2S_2.O_5.5H_2O$ 10g and $H_2O$ 100cc or a slurry of ZnS 10g and $H_2O$ 20 cc in lines each of about 1.5 mm wide as mentioned in Table 10 below; and after being placed in a furnace temperature of 500° C for 20 seconds, it was subjected the steel decarburizing annealing at 850° C in a wet hydrogen atmosphere for 4 minutes. The said sample was painted with a separator for annealing, and subjected to final high-temperature annealing at 1200° C for 20 hours. The so worked steel sheets possesses magnetic properties as shown in Table 10.

Table 10

| Treating agent | Magnetic flux density $B_8$ (Wblm$^2$) | Watt loss $W_{17/50}$ (Watt/kg) | Arrangement |
|---|---|---|---|
| Not treated | 1.92 | 1.10 | (Control) |
| $K_2S$:5g | 1.95 | 1.02 | In lines running rectangular to the rolling direction with an interval of 10 mm |
| $H_2O$:62.5cc | 1.96 | 1.05 | In lines of two kinds one running rectangular to the rolling direction with an interval of 10 mm and the other running parallel with the rolling direction with an interval of 10 mm |
| $Na_2S_2O_5$ . $5H_2O$:10g | 1.96 | 1.02 | In lines running rectangular to the rolling direction with an interval of 10 mm |
| $H_2O$:100cc | 1.97 | 1.04 | In lines of two kinds one running rectangular to the rolling direction with an interval of 10 mm and the other running parallel with the rolling direction with an interval of 10 mm |
| $Z_nS$:10g<br>$H_2O$:20cc | 1.95 | 1.03 | In lines running rectangular to the rolling direction with an interval of 10 mm |

It can be known from the above table that compared with the control which was not-worked, the steel sheets worked with the abovementioned treating agents have smaller wattage losses and higher magnetic flux densities.

EXAMPLE 8

A sample sheet of steel having the same content as that of sample sheet of Example 7 was cold-rolled to a thickness of 0.35 mm, said cold-rolled steel sheet was subjected to decarburizing annealing at 850° C in a wet hydrogen stmosphere for 4 minutes. Said steel sheet was then painted with a solution of 85% $H_3PO_4$ or $Na_2HPO_4.12H_2O$ 50g and 85% $H_3PO_4$ 20cc and $H_2O$ 50 cc in lines each of about 1 mm wide as mentioned in Table 11 below; and desiccated at a furnace temperature of 500° C for 20 seconds. Then, said sample was painted with an annealing separation agent, and subjected to a final high-temperature annealing at 1200° C for 20 hours.

As shown in Table 11 below, the steel sheets worked with said treating agents have a smaller wattage loss and higher magnetic flux density Table II

| Treating solution | Magnetic flux density $B_8$ (Wb/m$^2$) | Watt loss $W_{17/50}$ (Watt/kg) | Arrangement |
|---|---|---|---|
| Not treated | 1.93 | 1.27 | (control) |
| $Na_2HPO_4$ . $12H_2O$:50g<br>85%$H_3PO_4$:20cc<br>$H_2O$:5cc | 1.98 | 1.20 | In lines running rectangular to the rolling direction with an interval of 7 mm |
| 85%$H_3PO_4$ | 1.95 | 1.18 | In lines of two kinds one running in the direction rectangular to the rolling direction with an interval of 7mm, and the other running parallel with the rolling direction |

Table II-continued

| Treating solution | Magnetic flux density $B_8$ (Wb/m²) | Watt loss $W_{17/50}$ (Watt/kg) | Arrangement |
|---|---|---|---|
| | | | with an interval of 7 mm. |

EXAMPLE 9

A sample sheet of silicon steel containing carbon 0.048%, silicon 2.90%, sulfur 0.025% and acid-soluble aluminum 0.028% was hot-rolled, continuously annealed at 1130° C for 2 minutes, pickled, and then cold-rolled to a thickness of 0.28 mm. Said cold-rolled steel sheet was washed by oil, and painted in lines each of about 1 mm wide with an aqueous solution of a surface activating agent (hygen EP 17C) 0.2g in $H_2O$ 100cc, with fine particles of aluminum 32g added. Such lines having an interval of 15 mm between the two adjacent ones, took two directions that is, rectangular to and parallel with the rolling direction. Said steel sheet was subjected to decarburizing annealing at 850° C in a wet hydrogen atmosphere for 4 minutes; and after being painted with an annealing separation agent, it was subjected to final high-temperature annealing at 1,200° C for 20 hours.

The following table shows the magnetic properties given to sample pieces of the so worked steel sheet:

Table 12

| | Control (not worked) | | Worked steel sheet | |
|---|---|---|---|---|
| Sample | $B_8$(Wb/m²) | $W_{17/50}$ (Watt/kg) | $B_8$(Wb/m$^a$) | $W_{17/50}$ (Watt/kg) |
| A | 1.90 | 1.16 | 1.93 | 1.05 |
| B | 1.92 | 1.09 | 1.94 | 1.02 |
| C | 1.93 | 1.06 | 1.95 | 0.97 |
| D | 1.91 | 1.10 | 1.95 | 1.00 |

As shown in Table 12 above, the steel sheets which were worked as mentioned above have smaller watt losses and higher magnetic flux densities than the not so worked sheet.

What is claimed is:

1. In a method of producing a grain-oriented electromagnetic steel sheet which comprises the steps of subjecting a sheet of hot-rolled silicon steel containing silicon in amounts less than 4.5% to more than one operation of cold rolling and more than one operation of annealing so as to set the thickness of the steel sheet to that of a commercially standard thickness, which annealing steps also includes that of a final high-temperature annealing step, the improvement which comprises the step of subjecting at least one surface of the steel sheet prior to the final high-temperature annealing to mechanical plastic working in a series of parallel linear regions of 0.05 to 3.0 mm wide in at least one direction of the surface of the steel sheet, said linear worked regions being spaced apart at distances of 5.0 to 25.0 mm so that the surface of the steel sheet is composed of alternate parallel lines of worked and unworked regions of the specified widths, wherein the worked regions serve to inhibit the secondary recrystallization growth in the unworked regions.

2. A method according to claim 1 wherein the mechanical plastic working is accomplished by means of shot peening.

3. A method according to claim 1 wherein the mechanical plastic working is accomplished through cold rolling by means of step rolls.

4. A method according to claim 1 wherein the mechanical plastic working is accomplished by means of scribers.

5. A method according to claim 1 wherein the mechanical plastic working step is applied to one surface of the steel sheet.

6. A method according to claim 1 wherein the mechanical plastic working step is applied to both surfaces of the steel sheet.

7. A method according to claim 1 wherein the mechanical plastic working step is applied in the rolling direction of the steel sheet.

8. A method according to claim 1 wherein the mechanical plastic working step is perpendicular to the rolling direction of the steel sheet.

9. In a method of producing a grain-oriented electromagnetic steel sheet which comprises the steps of subjecting a sheet of hot-rolled silicon steel containing silicon in amounts less than 4.5% to more than one operation of cold rolling and more than one operation of annealing so as to set the thickness of the steel sheet to that of a commercially standard thickness, which annealing steps also includes that of a final high-temperature annealing step, the improvement which comprises the step of subjecting at least one surface of the steel sheet prior to the final high-temperature annealing to working by means of a local heat treatment at a temperature of more than 600° C, said heat treatment being effected in a series of parallel linear regions of 0.05 to 3.0 mm wide in at least one direction on the surface of the steel sheet, said linear heat-treated regions being spaced apart at distances of 5.0 to 25.0 mm so that the surface of the steel sheet is composed of alternate parallel lines of worked and unworked regions having the above specified widths, wherein the worked heat-treated regions serve to inhibit the secondary recrystallization growth in the steel sheet.

10. A method according to claim 9 wherein the local heat treatment is carried out by irradiation using infrared rays by means of infrared ray bulbs.

11. A method according to claim 9 wherein said local heat treatment is carried out by irradiation using a light ray.

12. A method according to claim 9 wherein said local heat treatment is carried out by irradiation utilizing electron beams.

13. In a method of producing a grain-oriented electromagnetic steel sheet which comprises the steps of subjecting a steel of hotrolled silicon steel containing silicon in amounts less than 4.5% to more than one operation of cold rolling and more than one operation of annealing so as to set the thickness of the steel sheet to that of a commercially standard thickness which annealing steps also includes that of final high-temperature annealing step, the improvement which comprises the step of subjecting at least one surface of the steel sheet prior to the final high-temperature annealing to working by means of a local chemical treatment, which local chemical treatment consists essentially of applying to the surface of the steel sheet a grain growth resistant material selected from the group consisting of MnS, CrS, CuS AlN, $V_3N_4$, $Al_2O_3$, a selenide, an antimonide, phosphoric acid, a phosphate, S,Mn,Cr,Cu,Al,Se and Sb, said local chemical treatment being applied to the surface of the steel sheet in a series of parallel linear regions of 0.05 to 3.0 mm wide in at least one direction of the steel sheet, said linear chemically-treated worked regions being spaced apart at distances of 5.0 to 25.0 mm so that the surface of the steel sheet is composed of alternate parallel lines of chemically-treated worked and unworked regions of the above specified widths, said chemically-treated steel sheet being subsequently subjected to heating during one of the annealing steps to diffuse the metal into the steel sheet, wherein the chemically-treated region serves to inhibit the secondary recrystallization growth in the steel sheet.

14. A method of claim 13 wherein the chemical treatment is applied by painting a solution of slurry of the grain growth resistant material in parallel lines on the surface of the steel sheet.

* * * * *